United States Patent [19]

Makar, Jr. et al.

[11] Patent Number: 4,803,403

[45] Date of Patent: Feb. 7, 1989

[54] END SEAL FOR CERAMIC ARC DISCHARGE TUBES

[75] Inventors: Francis B. Makar, Jr., Plaistow; George A. Fryburg, Hampton, both of N.H.

[73] Assignee: GTE Products Corporation, Stamford, Conn.

[21] Appl. No.: 88,461

[22] Filed: Aug. 3, 1987

Related U.S. Application Data

[63] Continuation of Ser. No. 528,716, Sep. 2, 1983, abandoned.

[51] Int. Cl.[4] ..... H01J 61/36

[52] U.S. Cl. ..... 313/624; 313/625

[58] Field of Search ..... 313/623, 624, 625; 445/26, 28

[56] References Cited

U.S. PATENT DOCUMENTS

| | | | |
|---|---|---|---|
| 3,363,134 | 1/1968 | Johnson | 313/625 |
| 4,063,127 | 12/1977 | Le Cain | 313/625 |
| 4,354,717 | 10/1982 | Rech et al. | 445/28 |
| 4,538,091 | 8/1985 | Lewis et al. | 445/26 |

FOREIGN PATENT DOCUMENTS

| | | | |
|---|---|---|---|
| 0060582 | 9/1982 | European Pat. Off. . | |
| 1041461 | 9/1966 | United Kingdom | 313/625 |

*Primary Examiner*—Kenneth M. Schor
*Attorney, Agent, or Firm*—William H. McNeill

[57] ABSTRACT

Sealing means for arc discharge tubes employ chamfers formed in the arc tube which mate with frusto-conical portions on sealing disks. Self-centering is thus provided as well as the elimination of one wire stop positioner for holding the sealing disks.

4 Claims, 2 Drawing Sheets

END SEAL FOR CERAMIC ARC DISCHARGE TUBES

This application is a continuation, of application Ser. No. 528,716, filed Sept. 2, 1983 now abandoned.

TECHNICAL FIELD

This invention relates to ceramic arc discharge tubes, such as of alumina or yttria; and more particularly to end seals thereof.

BACKGROUND ART

Certain arc discharge devices, such as high pressure sodium lamps, employ ceramic discharge tubes. These tubes generally comprise an elongated, tubular body of, for example, polycrystalline alumina, which have electrodes sealed into the ends thereof. The electrodes are mounted in disks of the same material as the arc tube. The disks have an outside diameter sized to fit within the inside diameter of the body with enough clearance to allow for the presence of a sealing material, such as a high temperature frit. The positioning of the electrode along the longitudinal axis of the device is usually accomplished by means of a wire stop which is secured to the electrode. A similar wire stop is used to position the disk and hold it in the proper position with the body for sealing. There are many problems with this type of seal. The disk itself can cock during the sealing operation which provides a poor seal and an off-center electrode. Two wire stops are used to support the disk and the electrode. Further, even though extremely tight tolerances are maintained on the arc tube inside diameter and the disk outside diameter, there is no convenient way to center the disk in order to provide the proper seal annulus. This annulus is critical for seal integrity.

DISCLOSURE OF THE INVENTION

It is, therefore, an object of this invention to obviate the disadvantages of the prior art.

It is another object of the invention to improve arc tube seals.

Yet another object of the invention is the provision of an arc tube seal that is self-centering.

These objects are accomplished, in one aspect of the invention, in an hermetically sealed arc tube which has an elongated, substantially cyclindrical body having an outside diameter and at least one inside diameter and having opposed ends. The at least one inside diameter widens to a diameter greater than the inside diameter and less than the outside diameter adjacent each of the opposed ends to form a chamfer. A sealing disk including at least a frusto-conical portion formed to mate with the chamfer is sealed into each end.

The employment of this invention provides a seal that is self-centering and self-positioning. One of the wire stops is eliminated and the disk will not cock during sealing. Further, the proper seal annulus is maintained.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
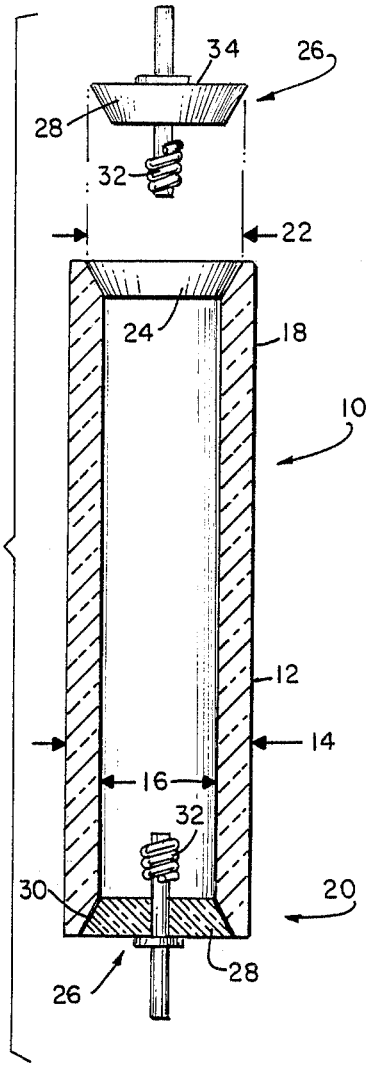
FIG. 1 is an exploded, sectional elevational view of an embodiment of the invention.

Referring now to the drawings with greater particularity, there is shown in FIG. 1 a ceramic arc tube 10 comprising a body 12 which is elongated, substantially cyclindrical and tubular. Body 12 has an outside diameter 14 and an inside diameter 16.

Adjacent the ends 18 and 20 the inside diameter 16 widens to form an intermediate diameter 22 which is greater than diameter 16 but less than diameter 14, thus forming a chamfer 24.

A sealing disk 26, which includes a frusto-conical portion 28 formed to mate with chamfer 24 is sealed into each end of body 12 by means of a sealing material 30 which forms a sealing annulus.

An electrode 32, which can be a conventional electrode for a high pressure sodium lamp, is sealed into a centrally located aperture in disk 26. A wire stop 34 can hold electrode 32 in position during sealing.

Figure 2:
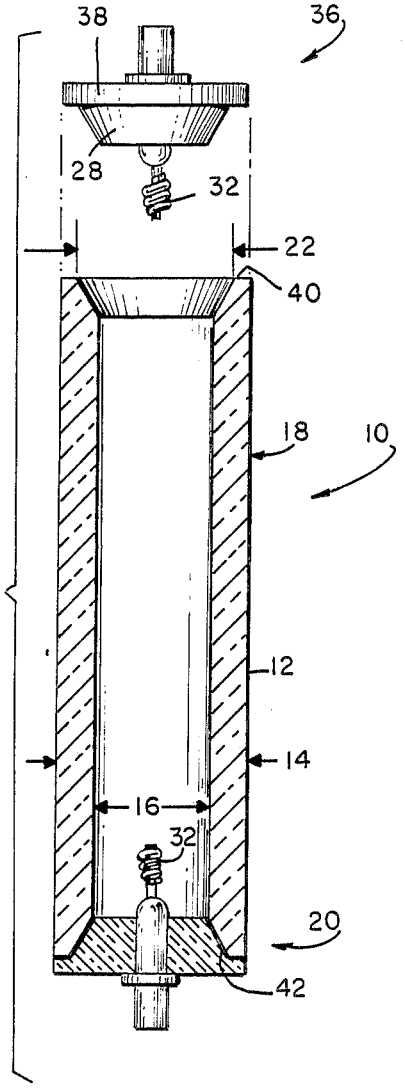
FIG. 2 is a similar view of an alternate embodiment.

In the alternate embodiment of FIG. 2, the sealing disk 36 is provided with a circumferential rim or flange 38 which seals additionally to the outermost planes 40 and 42 of ends 18 and 20, respectively.

Figure 3:
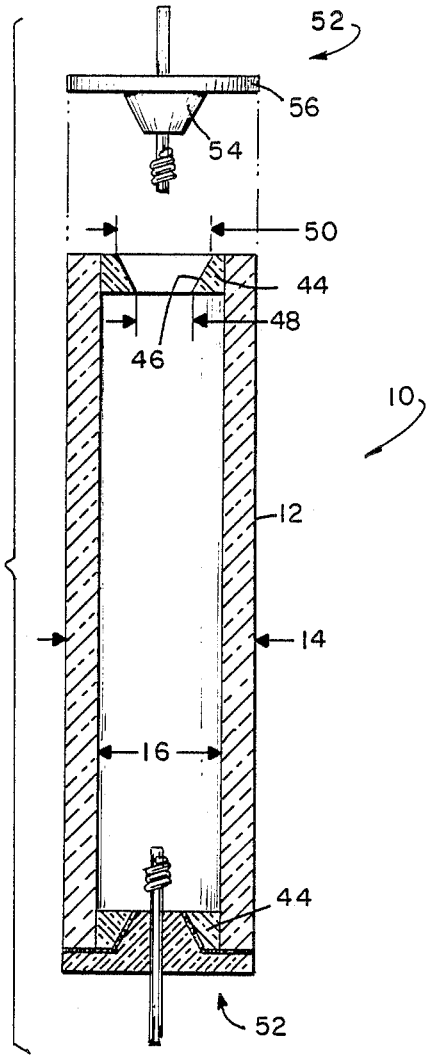
FIG. 3 is a similar view of yet another embodiment.

In the alternate embodiment shown in FIG. 3, the body 12 has an insert 44 sealed into each end, and the inserts 44 are provided with chamfers 46. Thus it will be seen that body 12 in FIG. 3 has a first inside diameter 16 for a substantial portion of its length and a second inside diameter 48 which is less than the diameter 16. The widest point of chamfers 46 is at diameter 50, which is also less than diameter 16 although greater than diameter 48.

The sealing disks 52 have a frusto-conical portion 54 for mating with chamfers 46 and also have the circumferential flange 56.

There is thus provided a sealing means for arc discharge devices such as high pressure sodium lamps which avoid the disadvantages of the prior art.

While there have been shown what are at present considered to be preferred embodiments of the invention, it will be apparent to those skilled in the art that various changes and modifications can be made herein without departing from the scope of the invention as defined by the appended claims.

We claim:

1. A hermetically sealed ceramic arc tube comprising: an elongated, substantially cylindrical, tubular body having an outside diameter, an inside diameter, and opposite ends each end having an end face, wherein, at a location adjacent each of said opposite ends, said inside diameter widens in a direction toward each of the end faces to a maximum diameter at each said end face which maxium diameter is greater than said inside diameter and less than said outside diameter to form a chamfer, and a sealing disc sealed into each of said ends, said sealing disc having a frusto-conical portion formed to mate with said chamfer and a circumferential flange formed to mate with the end face of said body, said circumferential flange having a diameter equal to said outside diameter.

2. The ceramic arc tube of claim 1 wherein said sealing disc has a central longitudinal aperture therein mounting an electrode.

3. A hermetically sealed ceramic arc tube comprising: an elongated, substantially cylindrical, tubular body having an outside diameter, a first inside diameter, and opposite ends each end having an end face, an annular insert having second and third inside diameters and being sealed within the hollow of said body at each end of the body such that the end of an insert is co-planar with the end face of the body, said second inside diameter being formed adjacent said ends and being less than said first inside diameter, said third inside diameter being greater than said second diameter and less than said first diameter said third inside diameter being located at said end faces and cooperating with said second diameter to form a chamfer which widens in diameter in a direction toward each of said end faces, and a sealing disc sealed into each of said ends, said sealing disc having a frusto-conical portion formed to mate with said chamfer and a circumferential flange formed to mate with the end face of said body, said circumferential flange having a diameter equal to said outside diameter.

4. The ceramic arc tube of claim 3 wherein said sealing disc has a central longitudinal aperture therein mounting an electrode.

* * * * *

UNITED STATES PATENT AND TRADEMARK OFFICE

CERTIFICATE OF CORRECTION

PATENT NO. : 4,803,403

DATED : February 7, 1989

INVENTOR(S) : Francis B. Makar Jr., George A. Fryburg

It is certified that error appears in the above-identified patent and that said Letters Patent is hereby corrected as shown below:

The term of this patent subsequent to February 7, 2006, has been disclaimed.

Signed and Sealed this

Twenty-seventh Day of February, 1990

*Attest:*

JEFFREY M. SAMUELS

*Attesting Officer* *Acting Commissioner of Patents and Trademarks*